US010774408B2

(12) United States Patent
Steinebach et al.

(10) Patent No.: US 10,774,408 B2
(45) Date of Patent: Sep. 15, 2020

(54) HIGH STRENGTH ALUMINUM STAMPING

(71) Applicant: MAGNA INTERNATIONAL INC., Aurora, Ontario (CA)

(72) Inventors: Edward K. Steinebach, Oak Ridge, TN (US); Mark Justin Jones, Knoxville, TN (US); Jeremiah John Brady, Knoxville, TN (US); Kenneth Ray Adams, Troy, MI (US); Gerard M. Ludtka, Oak Ridge, TN (US)

(73) Assignee: MAGNA INTERNATIONAL INC., Aurora (CA)

( * ) Notice: Subject to any disclaimer, the term of this patent is extended or adjusted under 35 U.S.C. 154(b) by 130 days.

(21) Appl. No.: 15/113,821

(22) PCT Filed: Jan. 23, 2015

(86) PCT No.: PCT/US2015/012588
§ 371 (c)(1),
(2) Date: Jul. 23, 2016

(87) PCT Pub. No.: WO2015/112799
PCT Pub. Date: Jul. 30, 2015

(65) Prior Publication Data

US 2016/0340766 A1 Nov. 24, 2016

Related U.S. Application Data

(60) Provisional application No. 61/931,254, filed on Jan. 24, 2014.

(51) Int. Cl.
*C22F 1/04* (2006.01)
*C22F 1/05* (2006.01)
(Continued)

(52) U.S. Cl.
CPC ..... *C22F 1/04* (2013.01); *B21D 22/022* (2013.01); *C22F 1/05* (2013.01); *C21D 1/673* (2013.01)

(58) Field of Classification Search
None
See application file for complete search history.

(56) References Cited

U.S. PATENT DOCUMENTS 5,194,102 A * 3/1993 Wyss ..... C22F 1/04 148/416
6,406,571 B1 6/2002 Gupta et al.
(Continued)

FOREIGN PATENT DOCUMENTS

| | | |
|---|---|---|
| CN | 1211287 A | 3/1999 |
| CN | 102459673 A | 5/2012 |
| WO | 9826107 A1 | 6/1998 |

OTHER PUBLICATIONS

Light Metal Age, Benedyk, Joseph C. ed.,"International Temper Designation Systems for Wrought Aluminum Alloys: Part II—Thermally Treated (T Temper) Aluminum Alloys", Aug. 2010, pp. 16 and 18-22.*

(Continued)

*Primary Examiner* — George Wyszomierski
(74) *Attorney, Agent, or Firm* — Dickinson Wright PLLC

(57) ABSTRACT

The invention provides a method of manufacturing a component formed of an aluminum alloy for use in an automotive vehicle application, for example those requiring high strength, light-weight, and a complex three-dimensional shape. The method begins by providing a blank formed of an aluminum alloy which is already solution heat treated and tempered, and thus has a temper designation of about T4. The method further includes heating the blank to a temperature of 150° C. to 350° C., preferably 190° C. to 225° C. The method next includes quickly transferring the blank to a hot (Continued)

Automotive Vehicle Application or warm forming apparatus, and stamping the blank to form the complex three-dimensional shape. Immediately after the forming step, the component has a temper designation of about T6, but preferably not greater than T6, and thus is ready for use in the automotive vehicle application without any post heat treatment or machining.

18 Claims, 1 Drawing Sheet

(51) Int. Cl.
*B21D 22/02* (2006.01)
*C21D 1/673* (2006.01)

(56) References Cited

U.S. PATENT DOCUMENTS 6,451,185 B2 9/2002 Beier et al.
2010/0319820 A1 12/2010 Koma
2012/0090742 A1 4/2012 Smyers et al.
2012/0227873 A1 9/2012 Morganti
2013/0228252 A1* 9/2013 Smeyers ..... C22C 21/10 148/537
2014/0366998 A1* 12/2014 Kamat ..... C22C 21/08 148/551
2015/0020930 A1* 1/2015 Kamat ..... C22C 21/00 148/551

OTHER PUBLICATIONS

Weritz, J., "The Aluminum Association Alloy and Temper System", presented to the Aluminum Extruders Council, Feb. 24, 2016.*
Richard C. Rice, et al.; Metallic Materials Properties Development and Standardization;7075 Alloy; Office of Aviation Research, vol. 1, Jan. 2003, pp. 3-369 and 3-389.
Gerard M. Ludtka, et al.; The Effect of Solute Content on the Slip Behavior in 7XXX Series Aluminum Alloys; American Society for Metals and The Metallurgical Society of AIME, vol. 12A, Dec. 1981, pp. 2083-2091.
Gerard M. Ludtka, et al.; The Influence of Microstructure and Strength on the Fracture Mode and Toughness of 7XXX Series Aluminum Alloys; American Society for Metals and The Metallurgical Society of AIME, vol. 13A, Mar. 1982, pp. 411-425.
Aluminum 7075-T-6; 7075-T651, MatWeb, http://www.matweb.com/search/SpecificMaterial.asp?bassnum=MA7076, accessed Jan. 24, 2007.

* cited by examiner

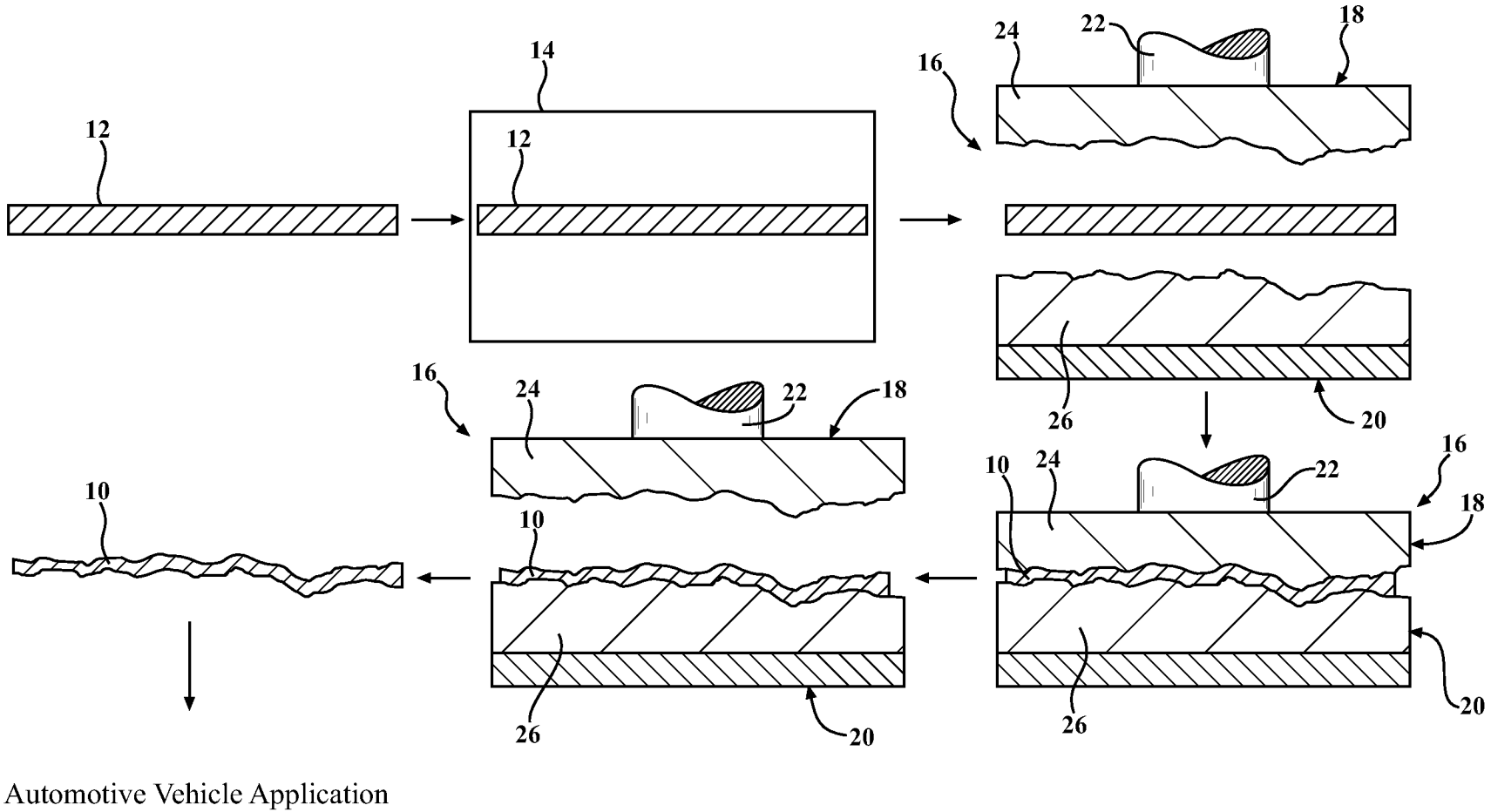
12
14
12
16
18
22
24
20
26
16
18
22
24
10
20
26
18
22
24
16
10
20
26
10
Automotive Vehicle Application

HIGH STRENGTH ALUMINUM STAMPING

CROSS-REFERENCE TO PRIOR APPLICATIONS

This U.S. National Stage Patent Application claims the benefit of PCT International Patent Application Ser. No. PCT/US2015/012588 filed Jan. 23, 2015 entitled "High Strength Aluminum Stamping," which claims the benefit of U.S. Provisional Patent Application Ser. No. 61/931,254, filed Jan. 24, 2014, entitled "High Strength Aluminum Hot Stamping," the entire disclosures of the applications being considered part of the disclosure of this application and hereby incorporated by reference.

GOVERNMENT LICENSE RIGHTS

This invention was made under Department of Energy (DOE) Contract No. DE-AC05-000R22725 between Magna International Inc. and UT-Battelle, LLC, operating and management Contractor for the Oak Ridge National Laboratory for the United States Department of Energy. The Government has certain rights in this invention.

BACKGROUND OF THE INVENTION

1. Field of the Invention

The invention relates generally to methods of manufacturing components formed of aluminum alloys, and more particularly components used in automotive vehicle applications.

2. Related Art

Structural components for automotive vehicle applications, such as bumpers and reinforcements, are oftentimes formed from aluminum alloys, rather than steel, due to the lighter weight of aluminum alloys. Typically, the component is formed to a complex three-dimensional shape, depending on the particular application in which the component is used. A high strength and specific temper designation is also typically required in the finished component.

The high-strength, light-weight aluminum component can be manufactured using a warm or hot forming process. For example, a stamping process including heat treatment and post tempering in an oven can be used to achieve the desired strength and temper designation. The stamping process can then be followed by machining the component to the complex three-dimensional shape. However, hot or warm stamping with post tempering and machining processes require high manufacturing costs and capital investment, which ultimately increases the price of the aluminum component and could outweigh the other benefits.

SUMMARY OF THE INVENTION

The invention provides a method of manufacturing a high-strength, light-weight component formed of an aluminum alloy and having a complex three-dimensional shape with reduced manufacturing costs and capital investment. The method includes providing a blank formed of an aluminum alloy selected from the group consisting of a 2000, 6000, 7000, 8000, and 9000 series aluminum alloy, wherein the aluminum alloy has already been solution heat treated and tempered. The method further includes heating the heat treated and tempered blank to a temperature of 150° C. to 350° C.; and forming the blank into a component having a three-dimensional shape after the heating step. During or immediately after the forming step, the aluminum alloy has a tensile strength and yield strength close to its maximum tensile and yield strength, and thus no post heat treatment process is required. In addition, a complex three-dimensional shape can be achieved during the forming step, such that no post machining process is required.

The invention also provides a component having a three-dimensional shape for use in an automotive vehicle application. The aluminum alloy is selected from the group consisting of: a 2000, 6000, 7000, 8000, and 9000 series aluminum alloy, and the aluminum alloy of the finished component has a temper designation close to T6. The temper designation is achieved by heating a solution heat treated and tempered blank formed of the aluminum alloy to a temperature of 150° C. to 350° C. before forming the blank to the three-dimensional shape.

BRIEF DESCRIPTION OF THE DRAWINGS

Other advantages of the present invention will be readily appreciated, as the same becomes better understood by reference to the following detailed description when considered in connection with the accompanying drawings, wherein:

FIG. 1 illustrates a method of manufacturing a product formed of an aluminum alloy according to one exemplary embodiment of the invention.

DESCRIPTION OF THE ENABLING EMBODIMENT

The invention provides a method of manufacturing a component 10 having a complex three-dimensional shape for use in an automotive vehicle application, such as a bumper or reinforcement. The component 10 is formed from an aluminum alloy to achieve a high strength and light-weight. In addition, the method can be performed with reduced manufacturing costs and reduced capital investment, compared to other methods used to manufacture similar high-strength, light-weight components. FIG. 1 illustrates this improved manufacturing method according to an exemplary embodiment.

The method first includes providing a blank 12 formed of the aluminum alloy. The blank 12 is typically a sheet of material, but can comprise any size and shape depending on the desired size and shape of the finished component 10. The aluminum alloy used to form the blank 12 is a 2000, 6000, 7000, 8000, or 9000 series aluminum alloy, which are internationally standardized alloys and well known in the art. Each series represents a different type of alloy, and each alloy within a series is registered by the Aluminum Association (AA). For example, aluminum alloys in the 2000 series are known as high strength alloys and typically include copper as the main alloying element, as well as magnesium. Alloys in the 6000 and 7000 series are also known as high strength alloys and are typically strengthened by heat treatment through precipitation of their main alloying elements, which are silicon and magnesium for the 6000 series, and copper, zinc, and magnesium for the 7000 series. The 8000 series alloys include less frequently used alloying elements, such as iron or tin. The 9000 series alloys are those that do not fall into one of the other series and are referred to as unassigned.

The blank 12 formed of the aluminum alloy is provided after already being solution heat treated and tempered. The solution heat treated and tempered blank 12 could be provided with a desired shape, or cut from a larger piece of material which has already been solution heat treated and tempered. Solution heat treating generally includes softening the aluminum alloy by heating and maintaining the alloy at an elevated temperature so that all of the alloying elements are in a single phase, solid solution. Tempering generally includes increasing the strength and/or hardness of the aluminum alloy by heating. After the solution heat treatment and tempering process, the aluminum alloy of the blank 12 typically has a temper designation of T4, or a temper designation that is close to T4. The T4 temper designation, as well as other temper designations T1-T10, are also registered by the Aluminum Association and are well known in the art. A list of all registered temper designations is published in the American National Standards Institute (ANSI) H35.1.

The method next includes heating the solution heat treated and tempered blank 12 to an elevated temperature in an oven or furnace 14, as shown in FIG. 1. The temperature of the heating step should be high enough so that upon removing the blank 12 from the furnace 14, the blank 12 can be transferred to a forming apparatus 16 and formed at a temperature of at least 150° C. The temperature and duration of the heating step is preferably controlled to achieve an ideal tensile strength and yield strength. In one embodiment, the heating step includes heating the blank 12 in the furnace 14 to a temperature of 190° C. to 225° C., or at least 204° C. The heating step also includes holding the blank 12 in that temperature range for a duration of 2 to 6 minutes. In the exemplary embodiments, the total residence time of the furnace 14 and duration of the heating step is typically 100 to 800 seconds.

The heating time and temperature should be selected so that the temper designation of the resulting component 10 is about T6, or close to T6, but preferably does not exceed a T6 temper, which could cause over-aging and corrosion issues. The time and temperature of the heating step can also be used to achieve the desired yield strength and/or tensile strength in the finished component 10. For example, for a 7000 series aluminum alloy, if the heating step includes holding the blank 12 at 204° C. for 6 minutes, then the yield strength and tensile strength of the 7000 series aluminum alloy after the heating step is about 75% of the yield strength ratio and tensile strength ratio, i.e. 75% of the maximum tensile yield and maximum tensile strength; and the finished component 10 has a yield strength and tensile strength of about 80% of the tensile strength ratio and yield strength ratio. In another embodiment, wherein the heating step is conducted at 232° C. for 6 minutes, the yield strength and tensile strength of the aluminum alloy is about 50% of the yield strength ratio and tensile strength ratio after the heating step, and the yield strength and tensile strength of the aluminum alloy in the resulting component 10 is about 70% of the yield strength ratio and tensile strength ratio. If the heating step is conducted at 275° C. for 6 minutes, then the yield strength and tensile strength of the aluminum alloy is about 30% of the yield strength ratio and tensile strength ratio after the heating step, and the yield strength and tensile strength of the aluminum alloy in the resulting component 10 is about 60% of the yield strength ratio and tensile strength ratio.

After the heating step, the method includes quickly transferring the heated blank 12 to the forming apparatus 16, as shown in FIG. 1. The duration of the transferring step is not greater than 15 seconds, for example 1 to 15 seconds, and preferably no longer than 12.5 seconds, so that the blank 12 stays at an appropriate temperature for forming. Alternatively, the blank 12 could be heated in the forming apparatus 16 before the forming step such that no furnace 14 is required.

In the exemplary embodiment of FIG. 1, the forming apparatus 16 includes an upper forming tool 18 and lower forming tool 20 spaced from one another, and the heated blank 12 is disposed in the space between the upper and lower forming tools 18, 20. The upper forming tool 18 includes a press 22 and an upper die 24 presenting a first predetermined shape, depending on the desired shape of the component 10 to be formed. The lower forming tool 20 includes a lower die 26 presenting a second predetermined shape, also depending on the desired shape of the component 10 to be formed. The dies 24, 26 can be designed such that the three-dimensional shape of the finished component 10 is complex and can be used in an automotive vehicle application.

Once the heated blank 12 is disposed in the forming apparatus 16, the method includes forming the heated blank 12 while the blank 12 is still at an elevated temperature, for example at a temperature of at least 150° C., or 150° C. to 350° C., or 190° C. to 225° C., or at least 204° C. The forming step typically includes stamping or pressing the blank 12 between upper forming tool 18 and lower forming tool 20. However, other techniques can be used to form the blank 12 to the desired shape after heating the solution heat treated and tempered blank 12 to the temperature of 150° C. to 350° C. and transferring the heated blank 12 to the furnace within 15 seconds. The alloy composition and temperature of the heating step allows complex three-dimensional shapes to be formed during the forming step without any post machining, which reduces manufacturing costs.

After the forming step, the finished component 10 is removed from the forming apparatus 16 and is ready for use in an automotive vehicle application, as shown in FIG. 1, without a post tempering process, or any other post heat treating process that would include heating the component 10 a temperature of at least 90° C. for at least 65 minutes after the forming step. Although no conventional post tempering process is required, the component 10 could be subjected to a conventional painting process, for example a process that includes heating the component 10 to temperatures ranging from 135° C. to 185° C. for a total of 60 minutes, before use in the automotive vehicle application.

The method described above provides a blank 12 with a high temper designation and strength after the heating step, and allows the aluminum alloy to maintain a high temper designation and strength during and after the forming step. For example, when the solution heat treated and tempered blank 12 provided at the beginning of the process (before the heating step) has a temper designation around T4, then the finished component 10 has a temper designation around T6, and preferably slightly below T6. The temper designation around T6 is achieved during the forming step, or immediately after the forming step. In other words, the aluminum alloy of the finished component 10 has a tensile strength equal to or greater than the minimum tensile strength of the same aluminum alloy having a temper designation of about T6. Thus, the component 10 is strong enough for use in many automotive vehicle applications, such as bumpers and reinforcements, without a costly post heating step.

The method can also including cooling or quenching the component 10 after the forming step. However, the cooling or quenching step does not change the physical or chemical properties of the aluminum alloy of the component 10. For example, the cooling step can including cooling the component 10 to room temperature, for example a temperature of about 30° C. In one embodiment, the cooling step is conducted in the forming apparatus 16, for example by conventional water cooling. In another embodiment, the component 10 is naturally cooled at room temperature outside the forming apparatus 16.

Another aspect of the invention provides a component 10 having a complex three-dimensional shape for use in an automotive vehicle application and manufactured according to the method described above. The component 10 is formed from an aluminum alloy selected from a 2000, 6000, 7000, 8000, and 9000 series aluminum alloy. The aluminum alloy of the finished component 10 also has a temper designation which is close to T6, and preferably not greater than T6. As described above, the temper designation of the finished component 10 is achieved by heating a solution heat treated and tempered blank 12 formed of the aluminum alloy to a temperature of 150° C. to 350° C. before forming the blank 12 to the three-dimensional shape. The aluminum alloy of the finished component 10 preferably has a tensile strength equal to or greater than the minimum tensile strength provided by a temper designation of about T6. In one embodiment, the component 10 is used in a bumper or reinforcement application, but it can be used in various other applications, particularly those requiring light-weight and high strength.

Many modifications and variations of the present invention are possible in light of the above teachings and may be practiced otherwise than as specifically described while within the scope of the following claims.

The invention claimed is:

1. A method of manufacturing a component formed of an aluminum alloy, comprising the steps of:

providing a blank formed of an aluminum alloy selected from the group consisting of: a 2000, 6000, 7000, 8000, and 9000 series aluminum alloy, wherein the blank provided is solution heat treated and tempered;

heating the solution heat treated and tempered blank and holding the heated blank at a temperature ranging from 150° C. to 350° C. for 2 to 6 minutes in a furnace;

transferring the heated blank from the furnace to a forming apparatus, the transferring step having a duration of not greater than 15 seconds; and stamping the solution heat treated blank into a component having a three-dimensional shape after the heating step and in the forming apparatus and while the blank is still heated and at a temperature of at least 150° C.

2. The method of claim 1, wherein the heating step includes holding the heat treated blank at a temperature ranging from 190° C. to 225° C. for 2 to 6 minutes.

3. The method of claim 2, wherein the heating step includes holding the heat treated blank at a temperature of at least 204° C.

4. The method of claim 1, wherein the stamping step occurs within 15 seconds after the heating step.

5. The method of claim 4, wherein the transferring has a duration of 1 to 15 seconds.

6. The method of claim 1, wherein the aluminum alloy of the component has a temper designation of T6 immediately after the stamping step.

7. The method of claim 1, wherein the aluminum alloy is selected from the group consisting of: a 6000, 7000, and 8000 series aluminum alloy; the aluminum alloy of the blank has a first temper designation of T4 before the heating step; the heating step includes heating the solution heat treated and tempered blank to a temperature ranging from 190° C. to 225° C.; and the aluminum alloy of the component has a second temper designation of T6 immediately after the stamping step.

8. The method of claim 1, wherein the aluminum alloy is a 7000 series aluminum alloy; and the aluminum alloy of the component has a yield strength of at least 75% of the maximum yield strength of the 7000 series aluminum alloy immediately after the stamping step.

9. The method of claim 1, wherein the stamping step includes stamping the blank between an upper forming tool and lower forming tool of the forming apparatus, the upper forming tool including a press and an upper die presenting a first predetermined shape, and the lower forming tool including a lower die presenting a second predetermined shape.

10. The method of claim 1, wherein the aluminum alloy of the component has a temper designation, and the method further including cooling the component after the stamping step, wherein the temper designation of the aluminum alloy of the component is unchanged during the cooling step.

11. The method of claim 1, wherein the alloy of the blank is selected from the group consisting of: a 6000, 7000, and 8000 series aluminum alloy, and the blank has a first temper designation of T4 before the heating step;

the heating step includes maintaining the solution heat treated and tempered blank at a temperature ranging from 190° C. to 225° C. in the furnace for 2 to 6 minutes;

the aluminum alloy of the component has a second temper designation of T6 immediately after the stamping step; and further including the steps of:

beginning the stamping step in the forming apparatus within 15 seconds after the heating step; and cooling the component after the stamping step, wherein the second temper designation of the aluminum alloy of the component is unchanged during the cooling step.

12. The method of claim 1 including heating and maintaining the aluminum alloy at an elevated temperature until all of the alloying elements are in a single phase, solid solution before heating the blank to a temperature of 150° C. to 350° C.

13. The method of claim 1 including increasing the strength and/or hardness of the aluminum alloy before heating the blank to a temperature of 150° C. to 350° C.

14. The method of claim 1, wherein the total residence time of the blank in the furnace and during the heating step is 100 to 800 seconds.

15. The method of claim 1 including no post machining of the three-dimensional shape of the blank after the stamping step.

16. The method of claim 1, wherein the three-dimensional shape of the component is the shape of a bumper or a reinforcement for an automotive vehicle.

17. The method of claim 1, wherein the aluminum alloy of the blank has a temper designation of T4 before the heating step, and the aluminum alloy of the component has a temper designation of T6 immediately after the forming step.

18. A method of manufacturing a component formed of an aluminum alloy, comprising the steps of:

providing a blank formed of an aluminum alloy selected from the group consisting of: a 2000, 6000, 7000, 8000, and 9000 series aluminum alloy, wherein the blank provided is solution heat treated and tempered;

heating the solution heat treated and tempered blank and holding the heated blank at a temperature ranging from 150° C. to 350° C. for 2 to 6 minutes; and stamping the solution heat treated blank into a component having a three-dimensional shape within 15 seconds after the heating step and while the blank is still heated and at a temperature of at least 150° C.

* * * * *